US012102124B2

(12) United States Patent
Zhou et al.

(10) Patent No.: US 12,102,124 B2
(45) Date of Patent: Oct. 1, 2024

(54) SEALING MEMBER, ATOMIZER AND ELECTRONIC ATOMIZING DEVICE

(71) Applicant: SHENZHEN SMOORE TECHNOLOGY LIMITED, Shenzhen (CN)

(72) Inventors: Weidong Zhou, Shenzhen (CN); Fengwen Lu, Shenzhen (CN); Min Wang, Shenzhen (CN); Xiaoan Zhu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 379 days.

(21) Appl. No.: 17/536,309

(22) Filed: Nov. 29, 2021

(65) Prior Publication Data

US 2022/0167671 A1 Jun. 2, 2022

(30) Foreign Application Priority Data

Nov. 27, 2020 (CN) ..... 202011352376.0

(51) Int. Cl.
*A24F 40/42* (2020.01)
*A24F 40/48* (2020.01)

(52) U.S. Cl.
CPC ..... *A24F 40/42* (2020.01); *A24F 40/48* (2020.01)

(58) Field of Classification Search
CPC ..... A24F 40/42; A24F 40/48; A24F 40/10; A24F 40/485
USPC ..... 131/329
See application file for complete search history.

(56) References Cited

U.S. PATENT DOCUMENTS

2018/0280653 A1 10/2018 Buchberger

FOREIGN PATENT DOCUMENTS

| | | | | | |
|---|---|---|---|---|---|
| CN | 208370938 U | * | 1/2019 | | |
| CN | 208523787 U | * | 2/2019 | | |
| CN | 109497616 A | * | 3/2019 | | |
| CN | 111035065 A | * | 4/2020 | | |
| CN | 210960427 U | | 7/2020 | | |
| CN | 111685371 A | * | 9/2020 | ..... | A24F 40/10 |
| EP | 3289897 A1 | * | 3/2018 | ..... | A24F 40/40 |
| EP | 3653066 A2 | | 5/2020 | | |

(Continued)

OTHER PUBLICATIONS

European Search Report for European Patent Application No. 21210706.4 mailed May 5, 2022.

*Primary Examiner* — Peter G Leigh
(74) *Attorney, Agent, or Firm* — Dorsey & Whitney LLP

(57) ABSTRACT

The present disclosure relates to a sealing member, an atomizer, and an electronic atomizing device. The atomizer includes a sealing member and a fixedly disposed atomizing core. The atomizer is provided with a liquid storage chamber, a mounting hole, and an inhalation passage. The sealing member includes a pulling part, a first sealing part, and a second sealing part that is provided on the atomizing core, both the pulling part and the first sealing part are movable relative to the mounting hole such that the sealing member has a sealed state and a use state. In the sealed state, the pulling part, the first sealing part, and the second sealing part are connected to each other, and the first sealing part and the second sealing part respectively isolate and seal the inhalation passage and the atomizing core from the liquid storage chamber.

19 Claims, 9 Drawing Sheets

(56) References Cited

FOREIGN PATENT DOCUMENTS

| | | | | | |
|---|---|---|---|---|---|
| WO | WO-2020083043 | A1 * | 4/2020 | ..... | A24F 40/10 |
| WO | 2020134766 | A1 | 7/2020 | | |

* cited by examiner

SEALING MEMBER, ATOMIZER AND ELECTRONIC ATOMIZING DEVICE

CROSS-REFERENCES TO RELATED APPLICATION

This application claims priority to Chinese Patent Application No. 202011352376.0, which was filed on Nov. 27, 2020 and entitled "SEALING MEMBER, ATOMIZER AND ELECTRONIC ATOMIZING DEVICE," the entire content of which is incorporated herein by reference.

TECHNICAL FIELD

The present disclosure relates to the technical field of electronic atomization, in particular to a sealing member, an atomizer, and an electronic atomizing device including the atomizer.

BACKGROUND

There are dozens of carcinogenic substances in a smoke from tobacco combustion, such as tar, which can cause very great harm to human health. In addition, the smoke diffuses in the air to form second-hand smoke, causing harm to human body after inhalation by surrounding people. Therefore, smoking is prohibited in most public places. An electronic atomizing device has an appearance and taste similar to those of ordinary cigarettes, but generally does not contain other harmful components such as tar and suspended particles in the cigarettes, thus the electronic atomizing device is commonly used as a substitute for cigarettes.

For a conventional electronic atomizing device, a liquid storage chamber cannot be completely sealed during transportation or storage before first use, and liquids in the liquid storage chamber can flow into an atomizing core under an influence of external factors such as negative pressure, vibration, and temperature change, thereby causing a risk of leakage of liquids in the atomizing core.

SUMMARY

A technical problem solved by the present disclosure is how to prevent potential leakage of an atomizer prior to first use.

An atomizer includes a sealing member and a fixedly disposed atomizing core. The atomizer is provided with a liquid storage chamber, a mounting hole, and an inhalation passage; wherein the sealing member includes a pulling part, a first sealing part, and a second sealing part that is provided on the atomizing core, both the pulling part and the first sealing part are movable relative to the mounting hole such that the sealing member has a sealed state and a use state;

in the sealed state, the pulling part, the first sealing part, and the second sealing part are connected to each other, and the first sealing part and the second sealing part respectively isolate and seal the inhalation passage and the atomizing core from the liquid storage chamber; the pulling part is provided in the inhalation passage, and an end of the pulling part protrudes from the inhalation passage; and/or in the use state, the pulling part is detached from the first sealing part and pulled out from the inhalation passage to open the inhalation passage; and the first sealing part is detached from the second sealing part to communicate the liquid storage chamber with the atomizing core.

In one embodiment, both the pulling part and the first sealing part slide relative to the mounting hole to be spaced apart from the second sealing part in a sliding direction when changing from the sealed state to the use state.

In one embodiment, the pulling part and/or the first sealing part are in an interference fit with the mounting hole in the sealed state; or the first sealing part is in an interference fit with the mounting hole in the use state.

In one embodiment, a connection strength between the first sealing part and the pulling part is a first connection strength, a connection strength between the first sealing part and the second sealing part is a second connection strength, and the first connection strength is greater than the second connection strength.

In one embodiment, the sealing member further includes a first connecting part and a second connecting part, the first sealing part includes an abutting part and a mating part connected to each other, and the mating part is capable of cooperating with the mounting hole, the first connecting part is connected between the mating part and the pulling part, a minimum cross sectional dimension of the first connecting part is less than cross sectional dimensions of the mating part and the pulling part; the second connecting part is connected between the second sealing part and the abutting part, and a minimum thickness of the second connecting part is less than a thickness of the second sealing part, a thickness of the abutting part, and a cross sectional dimension of the first connecting part.

In one embodiment, the first connecting part is located outside the inhalation passage.

In one embodiment, the second connecting part has an annular shape, and the second connecting part is provided around the abutting part in a circumferential direction.

In one embodiment, a cross sectional dimension of the abutting part is greater than the cross sectional dimension of the mating part; in the use state, the mating part is cooperated with the mounting hole, and the abutting part is fixed to the mating part and abutted outside the mounting hole.

In one embodiment, the second sealing part is sleeved on the atomizing core, the second sealing part has an inner surface in contact with the atomizing core, and the inner surface is provided with an air exchange groove; in the use state, the air exchange groove communicates the liquid storage chamber with the outside.

In one embodiment, the atomizer has an inner wall surface and a contact surface that are located outside the atomizing core, the second sealing part abuts against the contact surface, the inner wall surface is directly connected to the contact surface and defines a portion of a boundary of the liquid storage chamber, a liquid guide groove is defined on the inner wall surface, and an end of the liquid guide groove extends to a connecting part between the inner wall surface and the contact surface.

In one embodiment, the pulling part is capable of being in clearance fit with the mounting hole and the inhalation passage.

In one embodiment, the atomizer further includes a housing and a base assembly that collectively enclose the liquid storage chamber, wherein the mounting hole is defined on the base assembly, the atomizing core is disposed within the base assembly, the housing includes a casing and an inner tube provided with the inhalation passage, the casing is sleeved on the base assembly, the inner tube is located within the casing, one end of the inner tube is connected to the casing and the other end of the inner tube is inserted within the base assembly.

An electronic atomizing device includes a power supply assembly and an atomizer according to any one of the above, the power supply assembly is detachably connected to the atomizer.

A sealing member includes a pulling part, a first sealing part, and a second sealing part, the second sealing part is configured to be sleeved on a member to be sealed, a connection strength between the first sealing part and the pulling part is a first connection strength, a connection strength between the first sealing part and the second sealing part is a second connection strength, and the first connection strength is greater than the second connection strength.

In one of the embodiments, the sealing member further includes a first connecting part and a second connecting part, the first sealing part includes an abutting part and a mating part connected to each other, the first connecting part is connected between the mating part and the pulling part, a minimum cross sectional dimension of the first connecting part is less than cross sectional dimensions of the mating part and the pulling part; the second connecting part is connected between the second sealing part and the abutting part, the first sealing part, the second sealing part, and the second connecting part collectively enclose an open chamber for accommodating a workpiece, and a minimum thickness of the second connecting part is less than a thickness of the second sealing part, a thickness of the abutting part, and a cross sectional dimension of the first connecting part.

In one embodiment, the second connecting part has an annular shape, and the second connecting part is provided around the abutting part in a circumferential direction.

In one of the embodiments, a cross sectional dimension of the abutting part is greater than the cross sectional dimension of the mating part.

One embodiment of the present disclosure has a technical effect that, the sealing member is in the sealed state before the first use of the atomizer, and both the first sealing part and the second sealing part collectively block the liquid storage chamber, preventing the liquid in the liquid storage chamber from entering the atomizing core, and preventing the leakage liquid from the surface of the atomizing core from leaking out of the atomizer. In addition, the first sealing part blocks the mounting hole so that the liquid storage chamber and the inhalation passage are isolated from each other, preventing the liquid in the liquid storage chamber from entering the inhalation passage through the mounting hole, and finally preventing the liquid from leaking out of the atomizer through the inhalation passage. A potential liquid leakage in the atomizer is eliminated. Moreover, by providing the above-mentioned sealing member and fixing the atomizing core, stability and reliability of the mounting of the atomizing core can be improved.

DETAILED DESCRIPTION OF THE EMBODIMENTS

Figure 1:
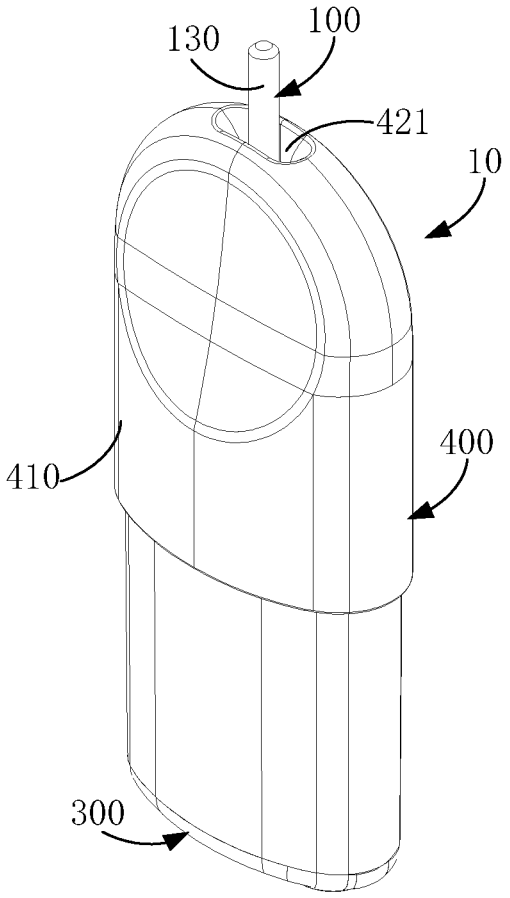
FIG. 1 is a schematic perspective view of an atomizer according to an embodiment when a sealing member is in a sealed state.

In order to facilitate the understanding of the present disclosure, the present disclosure will be described in a more comprehensive manner with reference to the relevant drawings. Preferred embodiments of the disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

It should be noted that when an element is referred to as being "fixed to" another element, it may be directly on another element or there may also be an intermediate element therebetween. When an element is considered to be "connected" to another element, it may be directly connected to another element or there may be an intermediate element therebetween. As used herein, the terms "inner", "outer", "left", "right", and similar expressions are for illustration only and are not meant to be the only embodiments.

Figure 2:
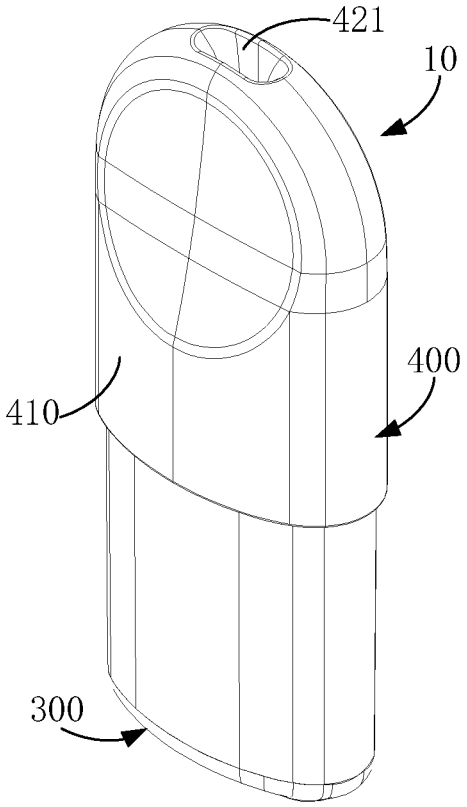
FIG. 2 is a schematic perspective view of the atomizer of FIG. 1 when the sealing member is in a use state.

Referring to FIGS. 1 and 2, an electronic atomizing device according to an embodiment of the present disclosure includes an atomizer 10 and a power supply assembly. The power supply assembly is connected to the atomizer 10, for example in a removable connection relationship between the atomizer 10 and the power supply assembly. The power supply assembly supplies power to the atomizer 10, which converts electrical energy into thermal energy, and liquid in the atomizer 10 absorbs the thermal energy and is atomized to form smoke that can be inhaled by a user. The liquid may be an aerosol generating substrate such as E-liquid. When the liquid in the atomizer 10 is completely consumed, the atomizer 10 can be removed from the power supply assembly and discarded, and then a new atomizer 10 filled with liquid can be re-mounted on the power supply assembly. Therefore, the atomizer 10 may be a disposable consumable, and the power supply assembly may be reused. After the power consumption in the power supply assembly is completed, the power supply assembly can be charged by an external charging device so that the power supply assembly can be recycled for the next time.

Figure 3:
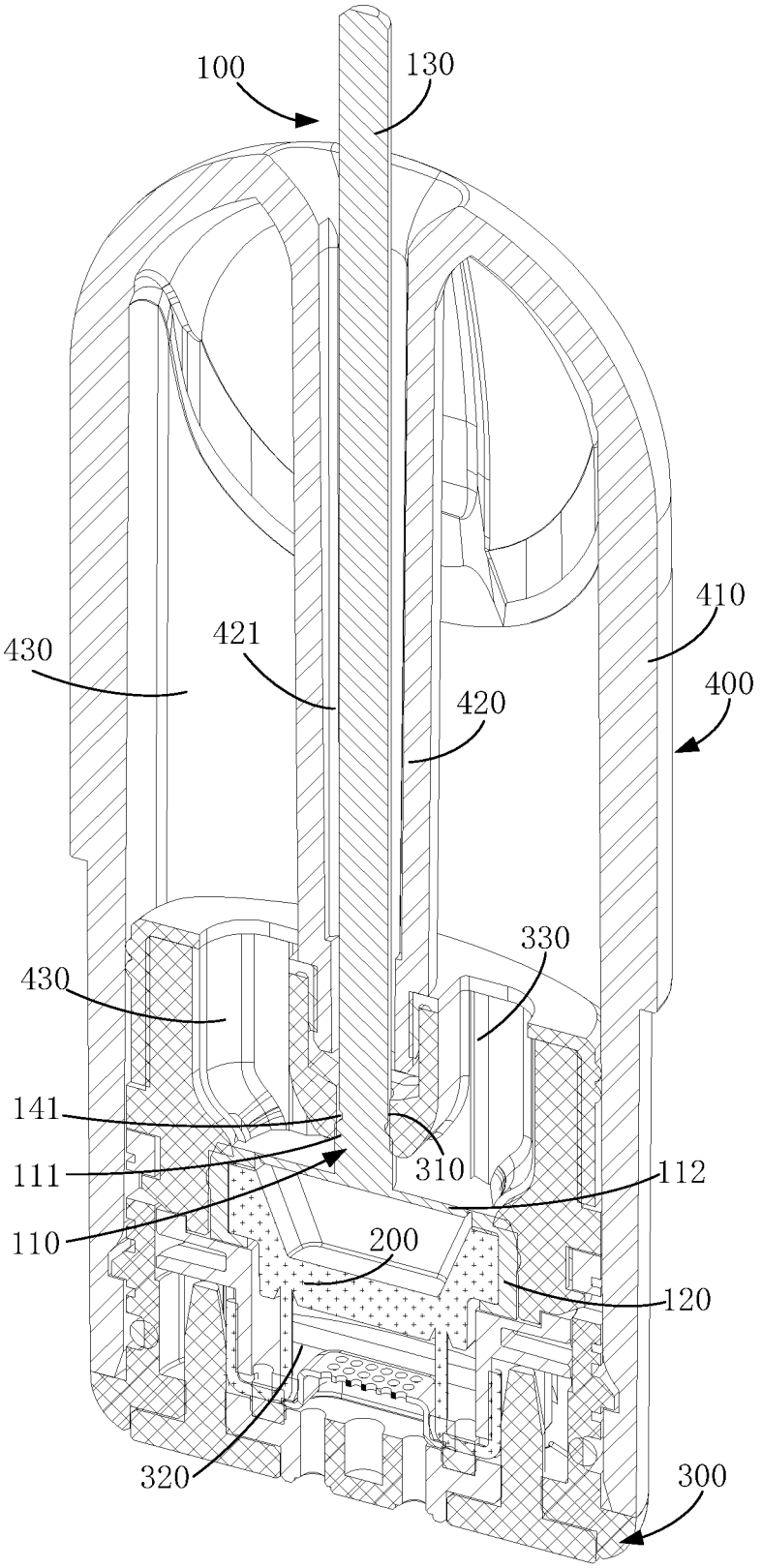
FIG. 3 is a schematic perspective sectional view of the atomizer of FIG. 1.

Referring to FIG. 3, in some embodiments, the atomizer 10 includes a sealing member 100, an atomizing core 200, a base assembly 300, and a housing 400. The atomizing core 200 is disposed within the base assembly 300. The housing 400 includes a casing 410 and an inner tube 420 having a substantially columnar structure. The inner tube 420 is disposed within a cavity formed by the casing 410. An upper end of the inner tube 420 is connected to the casing 410, and a lower end of the inner tube 420 is inserted within the base assembly 300. An inhalation passage 421 is defined in the inner tube 420 and extends in an axial direction of the inner tube 420. Both the housing 400 and the base assembly 300 collectively enclose a liquid storage chamber 430 for storing liquid. The base assembly 300 is further provided with a mounting hole 310 and an air intake passage 320 which communicates the inhalation passage 421 and the outside. When a user inhales at an upper end opening of the inhalation passage 421, air from outside carries smoke from the air intake passage 320 and enters an inside of the inhalation passage 421 through a lower end opening of the inhalation passage 421, so that the user can inhale the smoke at the upper end opening. Of course, with the sealing member 100 removed, the mounting hole 310 will communicate with both the liquid storage chamber 430 and the air intake passage at the same time.

The atomizing core 200 is fixedly disposed in the base assembly 300. The atomizing core 200 may include a ceramic substrate and a heating element. The ceramic substrate may be made of a porous ceramic material, so that there are a large amount of micropores inside the ceramic substrate to form a certain porosity, and the micropores may form a capillary action, so that the ceramic substrate can absorb and temporarily store the liquid stored in the liquid storage chamber 430. The ceramic substrate has an atomizing surface. The heating element may be made of metal material and attached to the atomizing surface. The heating element has a reasonable resistance value. When the power supply assembly energizes the heating element, the heating element converts electrical energy into thermal energy, and the liquid on the atomizing surface absorbs the thermal energy of the heating element to be atomized to form smoke.

Figure 5:
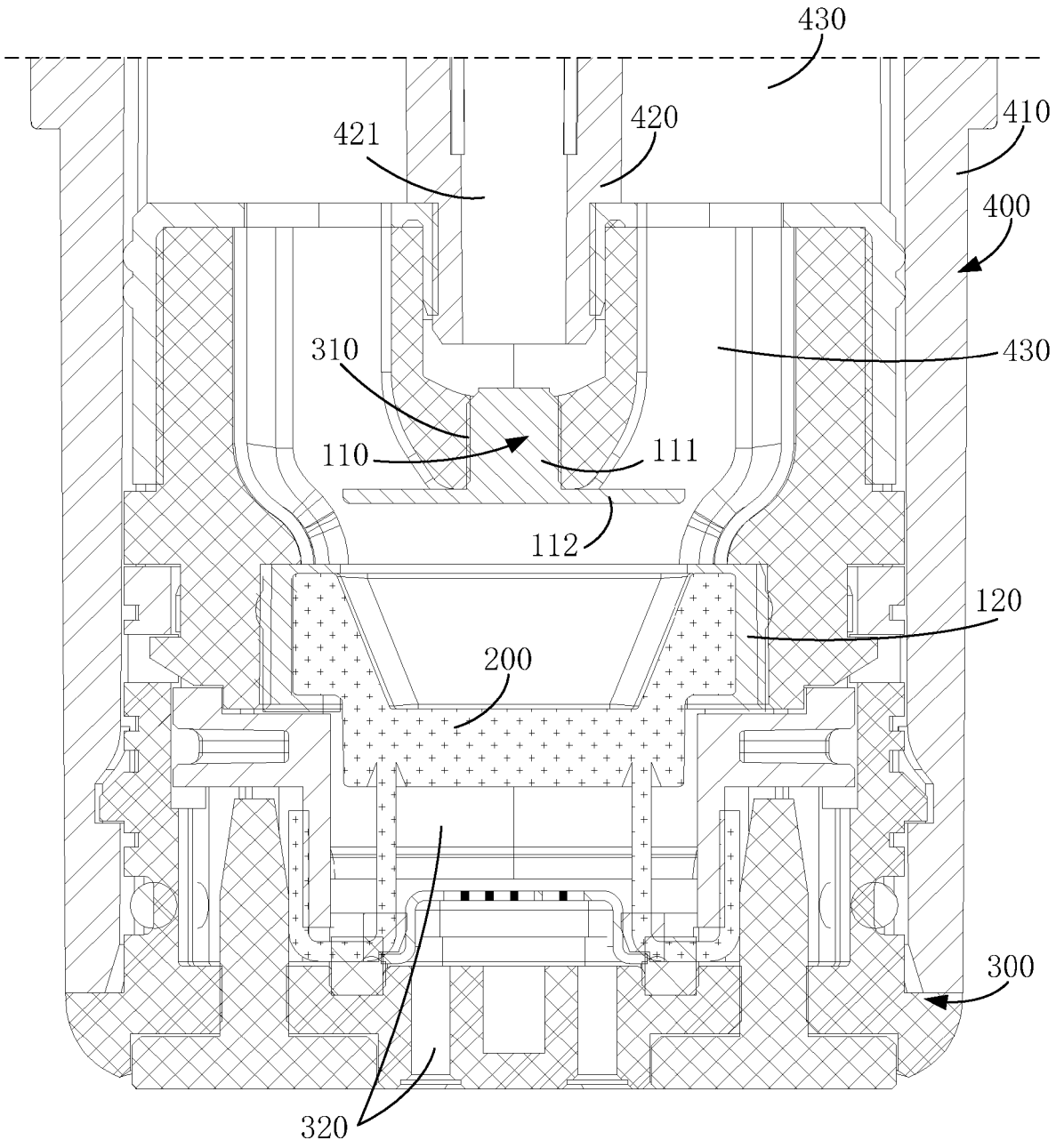
FIG. 5 is a schematic planar sectional view of the atomizer of FIG. 2 taken along a first direction.
Figure 6:
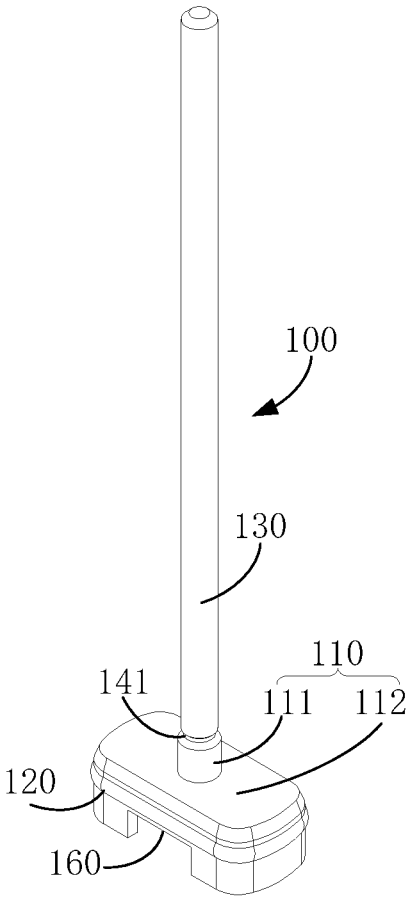
FIG. 6 is a schematic perspective view of the sealing member in the atomizer of FIG. 1.
Figure 7:
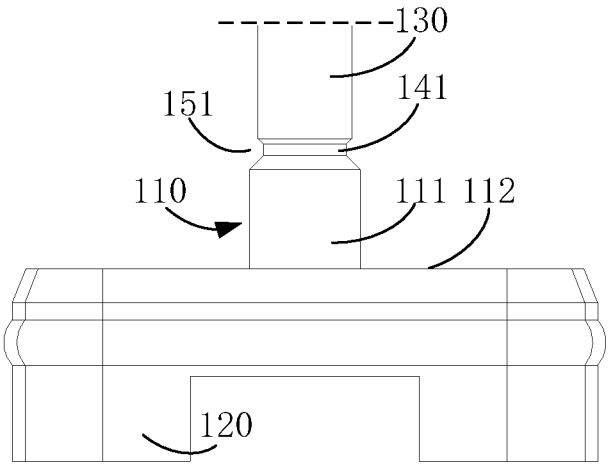
FIG. 7 is a schematic front view of the sealing member of FIG. 6.

Referring to FIGS. 3, 6, and 7, the sealing member 100 may be made of silicone material, and in this case the sealing member 100 is a silicone sealing member. The sealing member 100 includes a first sealing part 110, a second sealing part 120, and a pulling part 130. The first sealing part 110 is provided through the mounting hole 310, and the first sealing part 110 can always play a blocking effect on the mounting hole 310, thereby completely isolating the liquid storage chamber 430 and the inhalation passage 421 that can originally communicate with each other. The second sealing part 120 is provided on the atomizing core 200. The second sealing part 120 can seal gas and liquid, prevent leakage of liquid in the liquid storage chamber 430, and ensure gas tightness of the atomizer 10. The pulling part 130 is provided through the inhalation passage 421, and an end of the pulling part 130 protrudes from the inhalation passage 421. It is understood that the end of the pulling part 130 refers to an end that is not connected to the first sealing part 110. Both the first sealing part 110 and the pulling part 130 are movable relative to the mounting hole 310, so that the sealing member 100 has a sealed state and a use state. The user can realize a transition between the sealed state and the use state by pulling a free end of the pulling part 130. Of course, in some embodiments, both the sealed state and the use state are non-reversible, i.e., the sealing member 100 may be unidirectionally converted from the sealed state to the use state, but cannot be restored from the use state to the sealed state. In the sealed state shown in FIG. 4, the pulling part 130, the first sealing part 110, and the second sealing part 120 are connected to each other. The first sealing part 110 is connected between the pulling part 130 and the second sealing part 120, and the first sealing part 110 closes the liquid storage chamber 430 so that the atomizing core 200 and the liquid storage chamber 430 are isolated from each other, thereby preventing the liquid in the liquid storage chamber 430 from flowing into the atomizing core 200. In the use state shown in FIG. 5, the pulling part 130 is detached from the first sealing part 110 and pulled out from the inhalation passage 421, and the first sealing part 110 is detached from the second sealing part 120 and opens the liquid storage chamber 430, so that the liquid in the liquid storage chamber 430 can enter the atomizing core 200. In some specific embodiments, the sealing member 100 is made by integrally molding. It is understood that on the one hand, an integrally molding manner can achieve a better sealing effect, and avoid leakage of liquid from a gap or a joint; and on the other hand, an assembly process is simplified and a production and assembly efficiency is improved.

In some embodiments, a connection strength between the first sealing part 110 and the pulling part 130 is a first connection strength, a connection strength between the first sealing part 110 and the second sealing part 120 is a second connection strength, and a value of the first connection strength is greater than a value of the second connection strength. For example, the above-described connection strength may be expressed as a tensile strength, due to the first connection strength being greater than the second connection strength. When a gradually increasing tensile force is applied over the entire sealing member 100, the second connection strength will first reach a critical value such that the connection between the first sealing part 110 and the second sealing part 120 is broken and first detached away. After detachment, the first sealing part 110 is moved relative to the mounting hole 310. In the present embodiment, the first sealing part 110 and the mounting hole 310 are relatively slidable. As a movement of the first sealing part 110 relative to the mounting hole 310 is restricted and a tensile force continues to increase, the first connection strength will finally reach a critical value, such that the first sealing part 110 is finally detached from the pulling part 130. As another example, the above-described connection strength may be expressed as a torsional strength. When a gradually increasing torque is applied over the entire sealing member 100, the first sealing part 110 is first detached from the second sealing part 120, and the first sealing part 110 is finally detached from the pulling part 130.

Referring to FIGS. 3, 6, and 7, specifically, the sealing member 100 further includes a first connecting part 141 and a second connecting part 142. The pulling part 130 is provided through the inhalation passage 421, and the free end of the pulling part 130 protrudes a little distance from the upper end opening of the inhalation passage 421 before the atomizer 10 is first used, so that the free end of the pulling part 130 is exposed outside the entire casing 410, thus the user can apply a force to the pulling part 130. The entire pulling part 130 may have a substantially columnar structure, for example, a cylindrical structure. The first sealing part 110 includes a mating part 111 and an abutting part 112 that are connected to each other. The mating part 111 can be cooperated with the mounting hole 310. The mating part 111 may have a substantially cylindrical structure, and the abutting part 112 may have a substantially flat plate structure. The first connecting part 141 is connected between the mating part 111 and the pulling part 130. A minimum cross sectional dimension of the first connecting part 141 is less than the cross sectional dimensions of the mating part 111 and the pulling part 130, so that the minimum cross sectional dimension of the first connecting part 141 is the weakest part, and a structural strength of the weakest part is the first connection strength. The first connection strength will be lower than structural strengths of the mating part 111 and the pulling part 130. When a gradually increasing tensile force or torque is applied to the sealing member 100, the weakest part will be firstly broken, so that the pulling part 130 and the mating part 111 are detached from each other. That is, the entire pulling part 130 and the first sealing part 110 are detached from each other. Obviously, the mating part 111, the pulling part 130, and the first connecting part 141 will enclose an annular groove 151, i.e., the pulling part 130 and the first sealing part 110 will be broken first at the annular groove 151 therebetween.

Figure 9:
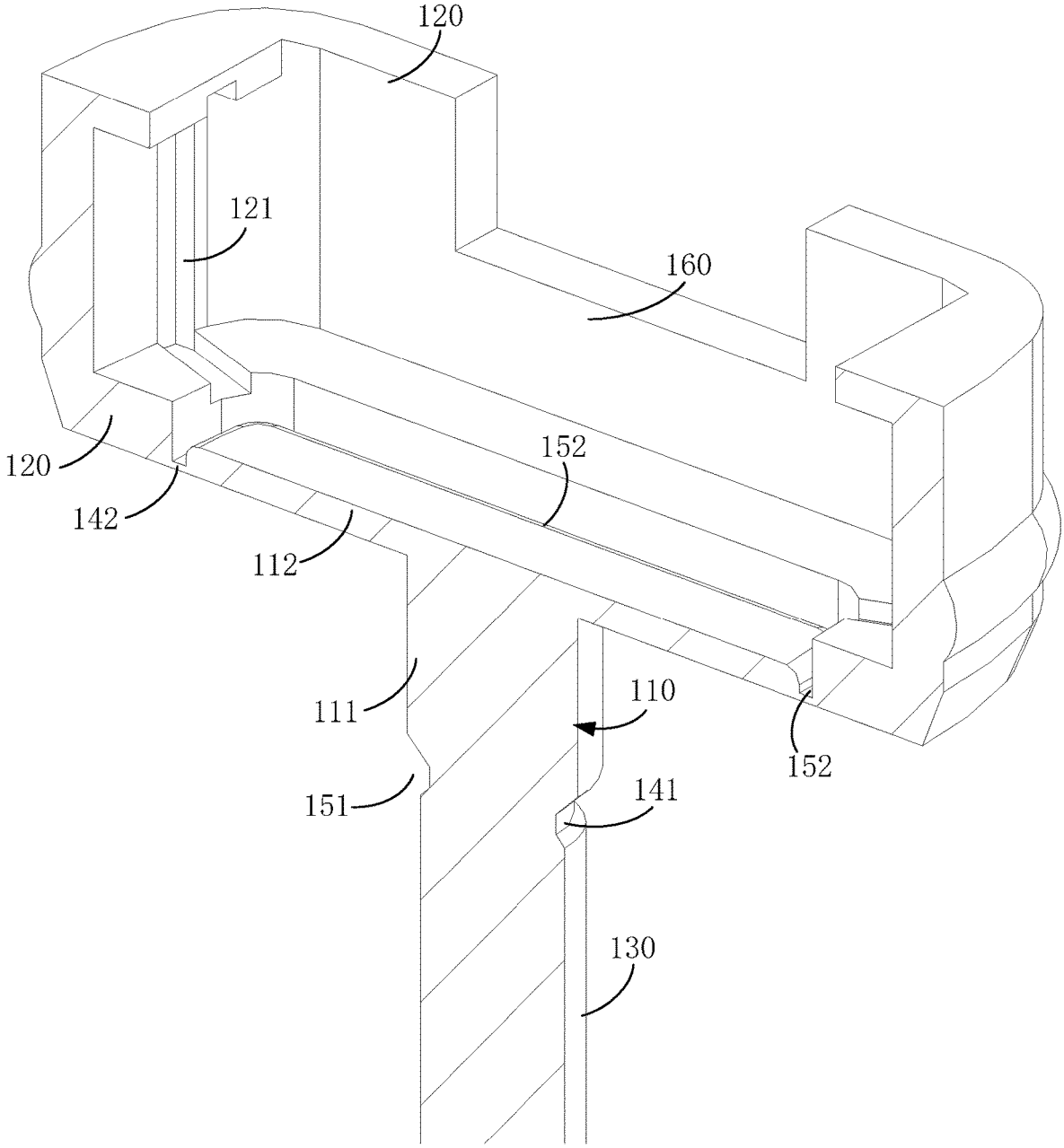
FIG. 9 is a schematic perspective sectional view of the sealing member of FIG. 6.

Referring to FIGS. 3, 6, and 9, the second connecting part 142 has a substantially annular structure, and the second connecting part 142 is connected to a periphery of the abutting part 112 so that the second connecting part 142 is provided around the abutting part 112. The second connecting part 142 is connected between the abutting part 112 and the second sealing part 120 so that the second sealing part 120 is likewise provided around the second connecting part 142. The second sealing part 120 has a substantially tubular structure and is sleeved on the atomizing core 200. The abutting part 112, the first connecting part 141, and the second sealing part 120 collectively enclose an open chamber 160 for accommodating the atomizing core 200. Obviously, the pulling part 130, the mating part 111, and the first connecting part 141 are all located outside the open chamber 160. A minimum thickness of the second connecting part 142 is less than thicknesses of the second sealing part 120 and the abutting part 112, so that the minimum thickness of the second connecting part 142 is the weakest part, and a structural strength of the weakest part is the second connection strength. The second connection strength will be lower than structural strengths of the abutting part 112 and the second sealing part 120. When a gradually increasing tensile force or torque is applied to the sealing member 100, the weakest part will be the firstly broken, so that the abutting part 112 and the second sealing part 120 are detached from each other. That is, the entire second sealing part 120 and the first sealing part 110 are detached from each other. Obviously, the second sealing part 120, the second connecting part 142 and the abutting part 112 will enclose an annular groove 152, i.e., the first sealing part 110 and the second sealing part 120 will be broken first at the annular groove 152 therebetween.

In addition, the minimum thickness of the second connecting part 142 is less than the cross sectional dimension of the first connecting part 141, so that the structural strength of the second connecting part 142 is lower than the structural strength of the first connecting part 141. That is, the second connection strength is lower than the first connection strength. When a gradually increasing tensile force or torque is applied to the sealing member 100, the second connecting part 142 is first broken relative to the first connecting part 141, so that the detachment between the first sealing part 110 and the second sealing part 120 precedes the detachment between the first sealing part 110 and the pulling part 130.

The cross sectional dimension of the pulling part 130 is less than the cross sectional dimension of the mating part 111, and the mating part 111 may form an interference fit relationship with the mounting hole 310 so that the mating part 111 can completely block the mounting hole 310. The pulling part 130 may form a clearance fit relationship with the inhalation passage 421 and the mounting hole 310, so that the pulling part 130 is easily pulled out from the inhalation passage 421 and the mounting hole 310, and frictional resistance of the entire sealing member 110 during sliding is reduced. The cross sectional dimension of the abutting part 112 is greater than the cross sectional dimension of the mating part 111, so that the abutting part 112 is completely prevented from being provided into the mounting hole 310.

Figure 4:
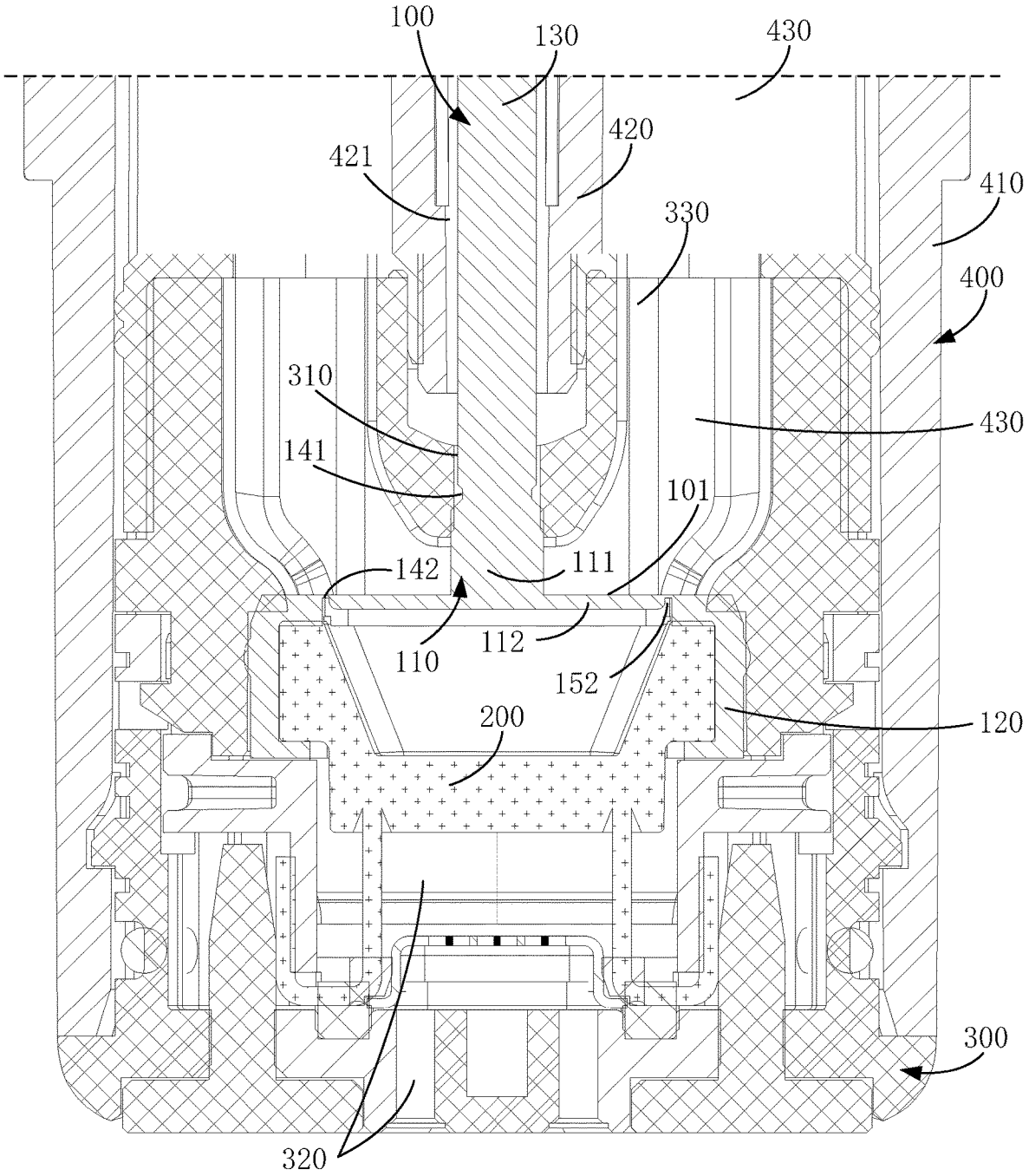
FIG. 4 is a schematic planar sectional view of the atomizer of FIG. 1.

Referring to FIGS. 3 and 4, the sealing member 100 is in the sealed state before the first use of the atomizer 10, and both the first sealing part 110 and the second sealing part 120 collectively block the liquid storage chamber 430, preventing the liquid in the liquid storage chamber 430 from entering the atomizing core 200, and preventing the leakage liquid from the surface of the atomizing core 200 from leaking out of the atomizer 10 through the air intake passage 320. In addition, the mating part 111 of the first sealing part 110 forms an interference fit with the mounting hole 310 so that the liquid storage chamber 430 and the inhalation passage 421 are completely isolated from each other, preventing the liquid in the liquid storage chamber 430 from entering the inhalation passage 421 through the mounting hole 310, and finally preventing the liquid from leaking out of the atomizer 10 through the inhalation passage 421. The first connecting part 141 may be positioned within the mounting hole 310. Therefore, by sealing the mounting hole 310 and the liquid storage chamber 430 with the sealing member 100, the liquid in the liquid storage chamber 430 can be effectively prevented from leaking out of the atomizer 10 through the inhalation passage 421 or the atomizing core 200, thereby eliminating the potential leakage of the liquid in the atomizer 10.

Figure 8:
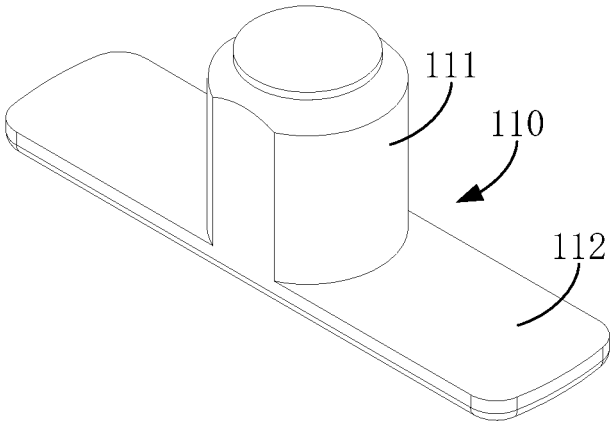
FIG. 8 is a schematic perspective view of a first sealing part in the sealing member of FIG. 6.

Referring to FIGS. 5, 6, and 8, the sealing member 100 may be placed in use state when it is desired to use the atomizer 10 to smoke. Specifically, by applying a gradually increasing tensile force to the pulling part 130 upwardly, the second connecting part 142 is first broken relative to the first connecting part 141, so that the abutting part 112 and the entire first sealing part 110 detach from the second sealing part 120 and move upwardly. In this case, the first sealing part 110 will open the liquid storage chamber 430 so that the liquid in the liquid storage chamber 430 can flow into the atomizing core 200. In a process in which the pulling part 130 drives the mating part 111 to continue to move upward relative to the mounting hole 310, the abutting part 112 moves upward along with the mating part 111. Since the abutting part 112 cannot pass through the mounting hole 310, when the abutting part 112 abuts against the base assembly 300 and is positioned outside the mounting hole 310, the first sealing part 110 stops moving, the abutting part 112 and the second sealing part 120 are disposed at an interval in a sliding direction (up-down direction) of the sealing member 100, and the mating part 111 and the mounting hole 310 form an interference fit to block the mounting hole 310. In a case where the tensile force continues to increase, the first connecting part 141 will be broken, so that the pulling part 130 is detached from the mating part 111, and finally the pulling part 130 is pulled out of the inhalation passage 421. In addition, the mating part 111 is cooperated only with the mounting hole 310 so that the mating part 111 cannot enter the inhalation passage 421. That is, the mating part 111 is located outside the inhalation passage 421, and the mating part 111 is prevented from blocking the inhalation passage 421 when being cooperated with the inhalation passage 421. Of course, in other embodiments, torque may be applied to the pulling part 130. That is, the pulling part 130 and the mating part 111 can rotate relative to the mounting hole 310 so that the second connecting part 142 and the first connecting part 141 are broken successively.

Figure 10:
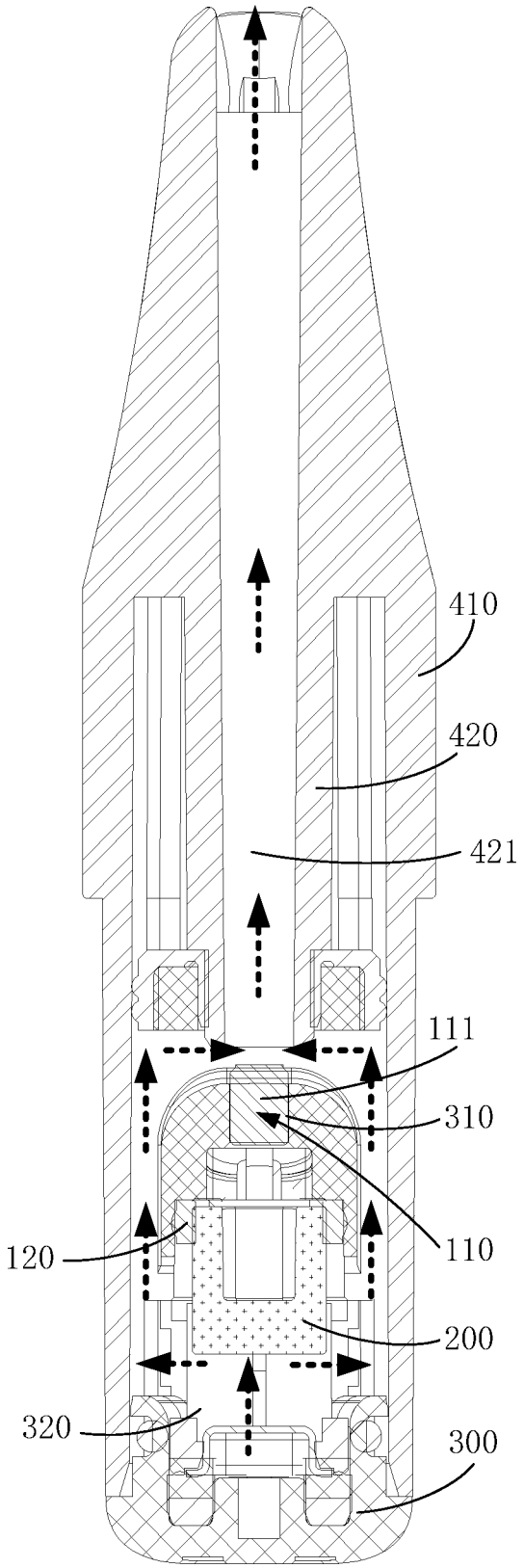
FIG. 10 is a schematic planar sectional view of the atomizer of FIG. 2 taken along a second direction.

When the abutting part 112 abuts against the base assembly 300 to completely open the liquid storage chamber 430, the liquid in the liquid storage chamber 430 enters the atomizing core 200, so that the atomizing core 200 is ready for atomizing the liquid. In this case, the mating part 111 still blocks the mounting hole 310, preventing the liquid in the liquid storage chamber 430 from leaking into the inhalation passage 421 through the mounting hole 310. When the first connecting part 141 is still connected to the mating part 111, the first connecting part 141 is positioned outside the inhalation passage 421 so that the mating part 111 and the first connecting part 141 do not block the inhalation passage 421. In addition, the pulling part 130 has been pulled out of the inhalation passage 421, on the one hand, the outside air can carry smoke into the inhalation passage 421 smoothly, and on the other hand, interference of the pulling part 130 can be eliminated, so that the user can inhale smoke at the upper end opening of the inhalation passage 421 (the dotted arrow shown in FIG. 10 is a flow path of air). Thus, when the sealing member 100 is in the use state, it is possible to enable the atomizer 10 to begin normal operation so that the user can inhale smoke.

By providing the above-mentioned sealing member 100 and fixing the atomizing core 200, stability and reliability of the mounting of the atomizing core 200 can be improved. The movement of the sealing member 100 relative to the atomizing core 200 may cause the sealing member 100 to transition from the sealed state to the use state. The sealing member 100 has a simple structure and can form a good sealing performance for the liquid storage chamber 430 and the mounting hole 310, thereby effectively preventing the liquid in the liquid storage chamber 430 from leaking. In addition, the first connection strength is greater than the second connection strength, so that the situation that the first sealing part 110 cannot be pulled further after the pulling part 130 and the first sealing part 110 are broken first can be prevented. It is ensured that the first sealing part 110 is first detached from the second sealing part 120 and blocks the mounting hole 310, and then the pulling part 130 is detached from the first sealing part 110 to smoothly pull out the inhalation passage 421, thereby facilitating an operation of converting the sealing member 100 from the sealed state to the use state. Of course, in other embodiments, the first connection strength may be less than the second connection strength, so that a high-pressure gas may be introduced to enable that the first sealing part 110 is then detached from the second sealing part 120 and blocks the mounting hole 310 after the pulling part 130 and the first sealing part 110 are broken first.

Referring to FIGS. 3 and 4, in some embodiments, the base assembly 300 has a contact surface and an inner wall surface disposed adjacent to the atomizing core 200. Obviously, the contact surface and the inner wall surface are located outside the atomizing core 200, and the contact surface is directly connected to the inner wall surface. The inner wall surface is used to define a portion of a boundary of the liquid storage chamber 430, and the inner wall surface is recessed to form at least one liquid guide groove 330. The liquid guide groove 330 may extend along the inner wall surface to a position above the abutting part 112 in the sealed state (i.e., a side away from the atomizing core 200), that is, an end of the liquid guide groove 330 may be spaced apart from a connecting part 101 between the contact surface and the inner wall surface. Of course, the end of the liquid guide groove 330 may extend directly to the connecting part 101 between the contact surface and the inner wall surface. When in the sealed state, both the first sealing part 110 and the second sealing part 120 cause the liquid guide groove 330 and the atomizing core 200 to isolate from each other, which prevents the liquid from entering the atomizing core 200 from the liquid guide groove 330. When in the use state, the abutting part 112 is detached from the second sealing part 120 such that the second sealing part 120 encloses a notch through which the liquid in the liquid guide groove 330 can enter the atomizing core 200. By providing the liquid guide groove 330, it is possible to make the liquid have a definite flow direction and avoid an occurrence of turbulence, so that the liquid in the liquid guide groove 330 rapidly flows into the atomizing core 200, thereby ensuring an amount of liquid per unit time required by the atomizing core 200 and avoiding a dry burning of the atomizing core 200 due to insufficient liquid supply.

Referring to FIGS. 5 and 9, in some embodiments, the second sealing part 120 has an inner surface in contact with the atomizing core 200, and the inner surface is provided with an air exchange groove 121, which communicates the liquid storage chamber 430 and the air intake passage 320 when the sealing member 100 is in the use state. When the liquid in the liquid storage chamber 430 is reduced due to consumption, the liquid storage chamber 430 will form a release space which is not filled with the liquid. In this case, the outside air enters the release space through the air intake passage 320 and an air exchange passage in sequence, so that an air pressure in the liquid storage chamber 430 is equal to an outside air pressure, which prevents that the liquid in the liquid storage chamber 430 cannot be rapidly supplied to the atomizing core 200 due to an occurrence of the negative pressure, and prevents the atomizing core 200 from a dry burning due to the insufficient liquid supply.

The technical features of the above described embodiments can be combined arbitrarily. To simplify the description, not all possible combinations of the technical features in the above embodiments are described. However, all of the combinations of these technical features should be considered as within the scope of the present disclosure, as long as such combinations do not contradict with each other.

The foregoing embodiments are merely some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements belong to the protection scope of the present disclosure. Therefore, the protection scope of the present disclosure shall be subject to the protection scope of the appended claims.

What is claimed is:

1. An atomizer, comprising:

a sealing member;

a fixedly disposed atomizing core;

a liquid storage chamber;

a mounting hole; and an inhalation passage;

wherein the sealing member comprises a pulling part, a first sealing part, and a second sealing part that is provided on the fixedly disposed atomizing core, both the pulling part and the first sealing part are movable relative to the mounting hole such that the sealing member has a sealed state and a use state;

wherein at least one of:

in the sealed state, the pulling part, the first sealing part, and the second sealing part are connected to each other, and the first sealing part and the second sealing part respectively isolate and seal the inhalation passage and the fixedly disposed atomizing core from the liquid storage chamber; the pulling part is provided in the inhalation passage, and an end of the pulling part protrudes from the inhalation passage; or in the use state, the pulling part is detached from the first sealing part and pulled out from the inhalation passage to open the inhalation passage; and the first sealing part is detached from the second sealing part to communicate the liquid storage chamber with the fixedly disposed atomizing core.

2. The atomizer according to claim 1, wherein both the pulling part and the first sealing part slide relative to the mounting hole to be spaced apart from the second sealing part in a sliding direction when changing from the sealed state to the use state.

3. The atomizer according to claim 2, wherein at least one of the pulling part or the first sealing part are in an interference fit with the mounting hole in the sealed state; or the first sealing part is in an interference fit with the mounting hole in the use state.

4. The atomizer according to claim 1, wherein the first sealing part and the pulling part exhibit a first connection strength therebetween, the first sealing part and the second sealing part exhibit a second connection strength therebetween, and the first connection strength is greater than the second connection strength.

5. The atomizer according to claim 4, wherein the sealing member further comprises a first connecting part and a second connecting part, the first sealing part comprises an abutting part and a mating part connected to each other, and the mating part is capable of cooperating with the mounting hole, the first connecting part is connected between the mating part and the pulling part, a minimum cross sectional dimension of the first connecting part is less than cross sectional dimensions of the mating part and the pulling part; the second connecting part is connected between the second sealing part and the abutting part, and a minimum thickness of the second connecting part is less than a thickness of the second sealing part, a thickness of the abutting part, and a cross sectional dimension of the first connecting part.

6. The atomizer according to claim 5, wherein the first connecting part is located outside the inhalation passage.

7. The atomizer according to claim 5, wherein the second connecting part has an annular shape, and the second connecting part is provided around the abutting part in a circumferential direction.

8. The atomizer according to claim 5, wherein the abutting part exhibits a cross sectional dimension that is greater than a cross sectional dimension of the mating part; in the use state, the mating part cooperates with the mounting hole, and the abutting part is fixed to the mating part and abutted outside the mounting hole.

9. The atomizer according to claim 1, wherein the second sealing part is sleeved on the fixedly disposed atomizing core, the second sealing part has an inner surface in contact with the fixedly disposed atomizing core, and the inner surface is provided with an air exchange groove; in the use state, the air exchange groove communicates the liquid storage chamber with the outside.

10. The atomizer according to claim 1, further comprising an inner wall surface and a contact surface that are located outside the fixedly disposed atomizing core, the second sealing part abuts against the contact surface, the inner wall surface is directly connected to the contact surface and defines a portion of a boundary of the liquid storage chamber, a liquid guide groove is defined on the inner wall surface, and an end of the liquid guide groove extends to a connecting part between the inner wall surface and the contact surface.

11. The atomizer according to claim 1, wherein the pulling part is capable of being in clearance fit with the mounting hole and the inhalation passage.

12. The atomizer according to claim 1, further comprising a housing and a base assembly that collectively enclose the liquid storage chamber, wherein the mounting hole is defined on the base assembly, the fixedly disposed atomizing core is disposed within the base assembly, the housing comprises a casing and an inner tube provided with the inhalation passage, the casing is sleeved on the base assembly, the inner tube is located within the casing, one end of the inner tube is connected to the casing and the other end of the inner tube is inserted within the base assembly.

13. An electronic atomizing device, comprising:

a power supply assembly; and the atomizer according to claim 1;

wherein the power supply assembly is detachably connected to the atomizer.

14. The atomizer according to claim 1, wherein the second sealing part is integrally formed with the pulling part and the second sealing part.

15. A sealing member, comprising:

a pulling part;

a first sealing part; and a second sealing part;

wherein the pulling part, the first sealing part, and the second sealing part are connected to each other, the second sealing part is configured to be sleeved on a member to be sealed, the first sealing part and the pulling part exhibit a first connection strength therebetween, the first sealing part and the second sealing part exhibit a second connection strength therebetween, and the first connection strength is greater than the second connection strength.

16. The sealing member according to claim 15, further comprising a first connecting part and a second connecting part, wherein the first sealing part comprises an abutting part and a mating part connected to each other, the first connecting part is connected between the mating part and the pulling part, a minimum cross sectional dimension of the first connecting part is less than cross sectional dimensions of the mating part and the pulling part; the second connecting part is connected between the second sealing part and the abutting part, the first sealing part, the second sealing part, and the second connecting part collectively enclose an open chamber for accommodating a workpiece, and a minimum thickness of the second connecting part is less than a thickness of the second sealing part, a thickness of the abutting part, and a cross sectional dimension of the first connecting part.

17. The sealing member according to claim 16, wherein the second connecting part has an annular shape, and the second connecting part is provided around the abutting part in a circumferential direction.

18. The sealing member according to claim 16, wherein the abutting part exhibits a cross sectional dimension greater than a cross sectional dimension of the mating part.

19. The sealing member according to claim 15, wherein the second sealing part is integrally formed with the pulling part and the second sealing part.

* * * * *